United States Patent [19]

Yamato et al.

[11] Patent Number: 4,808,951

[45] Date of Patent: Feb. 28, 1989

[54] DIELECTRIC FILTER

[75] Inventors: Osamu Yamato; Hiroyuki Horii; Tetuji Takino; Takanori Yamasaki; Yoshimitu Sakurai; Hisao Matsukura; Ichiro Iwase, all of Tokyo, Japan

[73] Assignee: Oki Electric Industry Co., Ltd., Tokyo, Japan

[21] Appl. No.: 48,633

[22] Filed: May 11, 1987

[30] Foreign Application Priority Data

May 12, 1986 [JP] Japan ..... 61-106820

[51] Int. Cl.[4] ..... H01P 1/20

[52] U.S. Cl. ..... 333/202; 333/206; 333/222

[58] Field of Search ..... 333/202, 203, 206, 207, 333/222–226, 237

[56] References Cited

U.S. PATENT DOCUMENTS

| | | | |
|---|---|---|---|
| 4,034,318 | 7/1977 | Ishiyama et al. | 333/193 |
| 4,234,859 | 11/1980 | Ikushima et al. | 333/194 X |
| 4,283,697 | 8/1981 | Masuda et al. | 333/202 |
| 4,342,972 | 8/1982 | Nishikawa et al. | 333/206 |
| 4,386,328 | 5/1983 | Masuda et al. | 333/202 |
| 4,426,631 | 1/1984 | D'Avello et al. | 333/206 X |
| 4,431,977 | 2/1984 | Sokola et al. | 333/206 |
| 4,450,421 | 5/1984 | Meguro et al. | 333/202 |
| 4,510,008 | 4/1985 | Hoshi et al. | 156/245 |
| 4,546,333 | 10/1985 | Fukusawa et al. | 333/202 |
| 4,560,965 | 12/1985 | Gosling et al. | 333/202 X |
| 4,639,699 | 1/1987 | Nishikawa et al. | 333/219 X |
| 4,670,080 | 6/1987 | Schwarz et al. | 156/307.5 |

FOREIGN PATENT DOCUMENTS

| | | | |
|---|---|---|---|
| 0114902 | 7/1984 | Japan | 333/202 |
| 0254802 | 12/1985 | Japan | 333/202 |
| 0080901 | 4/1986 | Japan | 333/202 |

OTHER PUBLICATIONS

The Encyclopedia of Chemistry, Reinhold Pub. Corp., p. 756, 1957.

*Primary Examiner*—Eugene R. Laroche
*Assistant Examiner*—Seung Ham
*Attorney, Agent, or Firm*—Wenderoth, Lind & Ponack

[57] ABSTRACT

A dielectric filter of which a characteristic is stable without a gastight casing. The dielectric filter's structure is comprised of an input, an output, a dielectric having a plurality of holes extending from a top to a bottom surface thereof, each of the holes being covered with a first conductive material, a second conductive material being electrically connected to the first conductive material at the bottom surface and unconnected to the first conductive material at the top surface, and an insulating weatherproof coating provided on the top surface.

15 Claims, 3 Drawing Sheets

DIELECTRIC FILTER

BACKGROUND OF THE INVENTION

The present invention is related to a dielectric filter comprised of ceramic material, and particularly to the dielectric filter to which radio frequency signals (hereafter referred to as RF signals) having a frequency range from the ultra high frequency (UHF) bands to the relatively low frequency microwave bands can be coupled, and which is well adapted for a bandpass filter coupling the RF signals having a frequency range either from 825 mHz to 845 mHz or from 870 mHz to 890 mHz.

A conventional dielectric filter structure is described in detail in U.S. Pat. Nos. 4,386,328 and 4,283,697 assigned to the assignee of the present invention.

The conventional dielectric filter as described above is generally sited in a conductive closed housing so as to sufficiently apply ground to the filter and prevent radiation generated by the filter from leaking and causing an electrical influence on other electrical parts.

The conductive closed housing comprised of a main body and a lid is, further, constructed as a gastight casing by means of being soldered between the main body and the lid in a thermostatic and humidistatic atmosphere, and as a result, is gastight so that the filter is prevented from deteriorating a characteristic thereof due to humidity.

The above mentioned filter, therefore, requires many manufacturing process steps, and will be consequently expensive.

SUMMARY OF THE INVENTION

Accordingly, an essential object of the present invention is to provide a dielectric filter of which a characteristic is stable without a gastight casing.

Briefly described, the dielectric filter of the present invention is comprised of an input means; an output means;

a dielectric means having a plurality of holes extending from a top to a bottom surface thereof, each of the holes being covered with a first conductive material;

a second conductive material provided on the dielectric means, the second conductive material being electrically connected to the first conductive material at the bottom surface and unconnected to the first conductive material at the top surface; and an insulating weatherproof means provided on the top surface.

DESCRIPTION OF THE PREFERRED EMBODIMENTS

Figure 1:
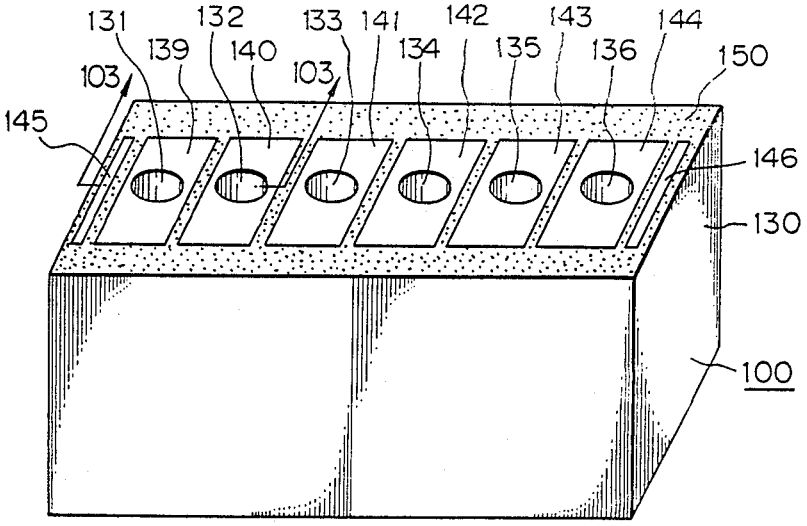
FIG. 1 is a perspective view of a dielectric filter which is well adapted for the present invention.

In FIG. 1, there is illustrated a dielectric filter which is well adapted for the present invention.

The dielectric filter 100 has a substantially rectangular solid-shaped block 130 which is made of ceramic material.

Figure 2:
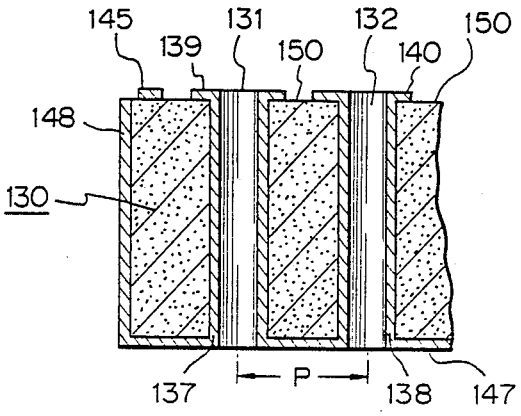
FIG. 2 is a cross section of the filter in FIG. 1 taken along lines 103—103.

The block 130 has six bores therethrough defining six parallel round holes 131–136, which respectively extend from a top surface to the bottom surface. The inner periphery of each bore in the block 130 defining each of the holes 131–136 is entirely covered with an electrically conductive material such as silver or copper as shown in FIG. 2. FIG. 2 is a cross section of the dielectric filter in FIG. 1 taken along lines 103—103, in which the holes 131 and 132 are covered with inner conductive layers indicated by the reference numerals 137 and 138, respectively. The inner conductive layers can be deposited on the surfaces of the holes by means of a conventional process such as a printing process or a plating process.

The inner conductive layers are electrically connected with one another by means of a bottom conductive layer 147 such as baked silver or copper paste which is provided on the bottom surface of the block 130. The bottom conductive layer 147 is electrically connected with an outer conductive layer 148 which is provided on the side surface of the block 130.

Each of the holes defined within with the inner conductive layer and surrounded by the dielectric material, which in turn is covered with the outer conductive layer connected with the inner conductive layer at the bottom thereof, will act as a dielectric resonator.

The block 130 has conductive collared areas 139–144, each of which is provided on the top surface of the block 130 so as to surround the end of the corresponding hole and be connected with the correspoonding inner conductive layers. The conductive collared areas 139–144 are shown as substantially rectangular shaped patterns in FIG. 1, but are not limited to the rectangular shape but rather, any shape of the pattern such as a round shaped pattern can be selected. These conductive collared areas 139–144 act as an electromagnetic coupler for coupling adjacent dielectric resonators.

RF signals are capacitively and electromagnetically coupled to and from the filter 100 in FIG. 1 by means of input and output electrodes 145, 146.

The resonance frequency of each dielectric resonator depends mainly upon the height of the hole and the dimension of the conductive collared area associated with the hole which are selected so as to construct substantially a quarter-wavelength coaxial resonator.

The adjusting operation of the resonance frequency is accomplished by the variation of the conductive collared area's dimension by means of a laser, sandblast trimmer or other suitable trimming process.

The amount of the coupling (which can be expressed by a coupling coefficient) between adjacent dielectric resonators depends elementally upon the pitch (P) therebetween (FIG. 2) and additionally upon the dimension of the conductive collared area. The fine adjustment of the coupling coefficient is easily performed by trimming the conductive collared area.

The quality factor Q of the filter depends upon the number of dielectric resonators, or plated holes. The frequency characteristics becomes sharp as the number of the dielectric resonators increases. Although there is illustrated the filter having six plated holes in FIG. 1, any number of plated holes can be selected so as to obtain predetermined frequency characteristics for the filter.

In the case of no conductive collared area, the filter will be provided with grooves or slots between adjacent dielectric resonators.

The above mentioned dielectric filter 100 has a bare dielectric portion 150 which is provided on the block 130 and uncovered with a conductive material with the exception of the conductive collared areas 139–144, the input and output electrodes 145, 146, the inner conductive layers, the bottom conductive layer 147 and the outer conductive layer 148.

In the filtering operation of the filter of FIG. 1, when RF signals are applied to the input electrode 145, the first dielectric resonator having the hole 131 generates the electromagnetic field.

This electromagnetic field is transferred through the area between adjacent conductive collared areas 139 and 140 to the second dielectric resonator having the hole 132, i.e. the energy of the electromagnetic field resulting from the first dielectric resonator concentrates on the area between the conductive collared areas 139 and 140. The electromagnetic field transferred to the second resonator is then transferred to the third resonator having the hole 133. In the same way, the electromagnetic field is transferred until the sixth dielectric resonator having the hole 136. Then, the energy of the electromagnetic field resulting from the sixth resonator is applied through the output electrode 146 to a load (not shown).

The above mentioned filter's structure is described in more detail in commonly assigned, copending U.S. Patent application Ser. No. 780,649 now abandoned.

Figure 3:
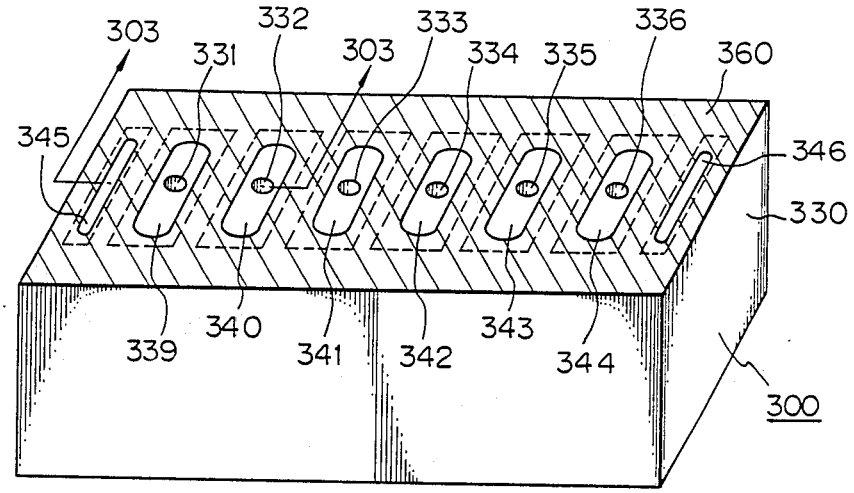
FIG. 3 is a perspective view of a dielectric filter embodying the present invention.

In FIG. 3, there is illustrated a dielectric filter embodying the present invention.

The dielectric filter 300 has a substantially rectangular solid-shaped block 330 which is made of ceramic material.

The block 330 has six bores therein defining six parallel round holes 331–336, which respectively extend from top surface to bottom surface thereof.

Figure 4:
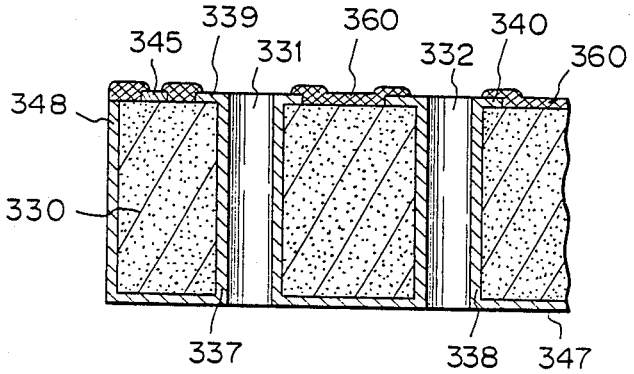
FIG. 4 is a cross section of the filter in FIG. 3 taken along lines 303—303.

The inner periphery of each bore in the block 330 defining each of the holes 331–336 is entirely covered with an electrically conductive material such as silver or copper as shown in FIG. 4. FIG. 4 is a cross section of the dielectric filter in FIG. 3 taken along lines 303—303, in which the holes 331 and 332 are covered with inner conductive layers 337, 338, respectively. The inner conductive layers are electrically connected with one another by means of a bottom conductive layer 347 such as baked silver or copper paste which is provided on the bottom surface of the block 330.

The bottom conductive layer 347 is electrically connected with an outer conductive layer 348 such as baked silver or copper paste which is provided on the side surface of the block 330.

The block 330 further has conductive collared areas 339–344, each of which is shown as a substantially rectangular shaped pattern and provided on the top surface of the block 330 so as to surround the end of the corresponding hole, and respectively connected with the corresponding inner conductive layers. These conductive collared areas 339–344 act as an electromagnetic coupler for coupling adjacent dielectric resonators.

RF signals are capacitively and electromagnetically coupled to and from the filter 300 in FIG. 3 by means of input and output electrodes 345, 346.

The dielectric filter 300 further has an organic material layer 360 comprised of an organic material such as an organic synthetic resin, preferably, a solder resist material which is a resist material containing epoxy resin.

The organic material layer 360 covers the bare dielectric portion of the block 330 which is uncovered with a conductive material with the exception of the conductive collared areas 339–344, the input and output electrodes 345, 346, the inner conductive layers, the bottom conductive layer 347 and the outer conductive layer 348.

The organic material layer 360 as shown in FIG. 3 is also over part of the input and output electrodes 345, 346 and the conductive collared areas 339–344.

The organic material layer may cover the entire dielectric filter 300. On the contrary, a part of the bare dielectric portion may remain without the organic material layer in the case where the remaining bare dielectric portion has little influence on the coupling between either the resonators or a electrode and an resonator, for example, a portion between each of the electrodes 345, 346 and the outer conductive layer 348.

The organic material layer 360, the thickness of which is about from 10 to 20 microns, is obtained by the steps of depositing an organic material comprising a thermoset organic resin layer on the surface of the filter by means of a screen printing process and heating the deposited organic material at a temperature of around 150° C. for thirty minutes so as to dry it.

The adjusting operation of the resonance frequency and the coupling coefficient of this dielectric filter is accomplished by trimming the conductive collared area.

The adjusting operation can be performed either before or, preferably after the organic material layer is deposited so as to effect a fine adjustment.

In the case of the adjustment being performed after the organic material layer is deposited, the filter will have an uncovered dielectric portion again, but the uncovered dielectric portion is generally able to be disregarded because of being small and, as a result, applies a small influence for a characteristic deterioration due to humidity exposed the dielectric filter.

If necessary, an organic material layer may be deposited on the uncovered dielectric portion.

With respect to the filtering operation, the above mentioned dielectric filter 300 shown in FIG. 3 is as substantially the same as the filter 100 as shown in FIG. 1.

Figure 5:
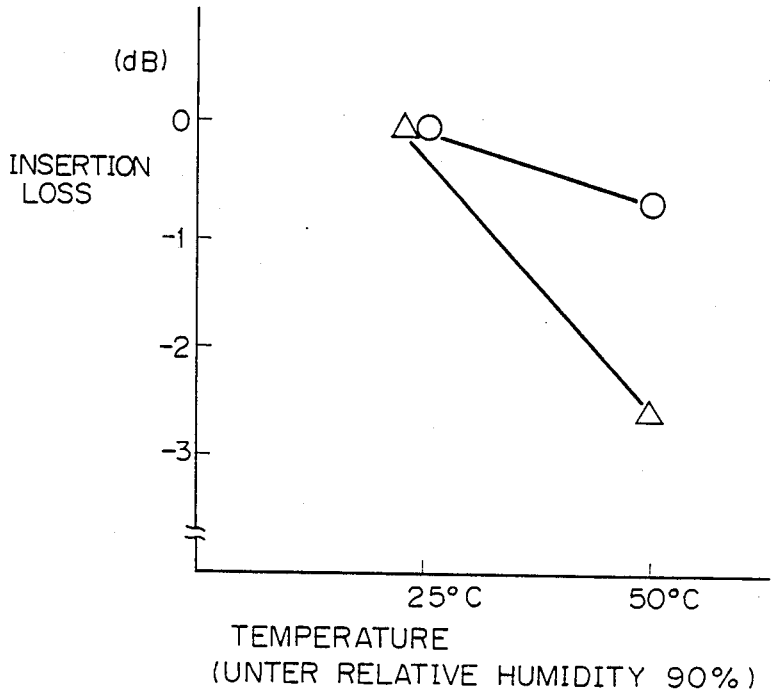
FIG. 5 a graph illustrating experimental weatherproof test results of the filters shown in FIG. 1 and FIG. 3.

In FIG. 5, there is illustrated experimental weathering test results of the filter as shown in FIG. 3 in comparison with the filter as shown in FIG. 1.

The weathering test was applied at temperatures of 25° C. and 50° C. under constant Relative Humidity (R.H.) 90 percent and the respective Insertion Loss was measured for each of the filters.

As a result of the weathering test, the Insertion Loss of both the filters was around minus 0.1 decibel (dB) at the temperature of 25° C., and at the temperature of 50° C. the Insertion Loss of the filter according to the present invention as shown in FIG. 3 was around minus 0.7 dB (which is designated as O in FIG. 5) and that of the filter as shown in FIG. 1 was around minus 2.5 dB (which is designated as Δ in FIG. 5).

The dielectric filter according to the present invention as shown in FIG. 3 is superior in weatherproofness to the filter of FIG. 1 and can be provided with a characteristic which is stable without a gastight casing.

In this embodiment according to the present invention, the organic material layer is explained as a solder resist, but any organic material which has insulation and weatherproofness properties can be usable.

The present invention may be practiced or embodied in still other ways without departing from the spirit or essential character thereof.

The preferred embodiment described herein is therefore illustrative and not restrictive, the scope of the invention being indicated by the appended claims and all variations which come within the meaning of the claims are intended to be embraced therein.

What is claimed is:

1. A filter having an input means and an output means therein, comprising:

means comprised of a dielectric material having top and bottom surfaces, the dielectric means having a plurality of holes defined by interior surfaces in the dielectric means extending from the top surface to the bottom surface thereof, the interior surfaces of each of the holes being covered with a first conductive material;

a second conductive material provided on the dielectric means, the second conductive material being electrically connected to the first conductive material at the bottom surface and unconnected to the first conductive material at the top surface; and means for preventing deterioration of a characteristic of the filter due to humidity comprising an epoxy resin material coating on the top surface, whereby the epoxy resin material prevents the filter from deteriorating the characteristic thereof due to humidity.

2. A filter according to claim 1, wherein the epoxy resin material is a deposited solder resist material on the top surface which has been subjected to a heat treatment.

3. A filter according to claim 2, wherein the solder resist material is a deposit by means of a screen process.

4. A filter according to claim 1, wherein said epoxy resin material covers only part of the top surface of said dielectric means, said epoxy resin material having a thickness of no greater than 20 microns.

5. A filter according to claim 1, wherein said epoxy resin material covers all of the top surface of said dielectric means without extending beyond an outer periphery of said dielectric means.

6. A filter having an input means and an output means therein, comprising:

means comprised of a dielectric material, a conductive material provided on the dielectric means, whereby the dielectric means acts as a dielectric resonator; and means for preventing deterioration of a characteristic of the filter due to humidity comprising an epoxy resin material coating on a bare dielectric portion of the dielectric means, the bare dielectric portion being uncovered with the conductive material, whereby the epoxy resin material prevents the filter from deteriorating the characteristic thereof due to the humidity.

7. A filter according to claim 6, wherein the epoxy resin material is a deposited solder resist material on the top surface which has been subjected to a heat treatment.

8. A filter according to claim 7, wherein the solder resist material is a deposit by means of a screen printing process.

9. A filter according to claim 6, wherein said epoxy resin material covers only part of the top surface of said dielectric means, said epoxy resin material having a thickness of no greater than 20 microns.

10. A filter according to claim 6, wherein said epoxy resin material covers all of the top surface of said dielectric means without extending beyond an outer periphery of said dielectric means.

11. A filter having an input means and output means therein, comprising:

a plurality of dielectric resonators;

a coupling means for capacitively coupling adjacent dielectric resonators; and means for preventing deterioration of a characteristic of the filter due to humidity comprising an epoxy resin material coated on the coupling means, whereby the epoxy resin material prevents the filter from deteriorating the characteristic thereof due to humidity.

12. A filter according to claim 11 wherein the epoxy resin material is a deposited solder resist material on a top surface of the filter which has been subjected to a heat treatment.

13. A filter according to claim 12, wherein the solder resist material is a deposit by means of a screen printing process.

14. A filter according to claim 11, wherein said epoxy resin material covers only part of a top surface of the filter, said epoxy resin material having a thickness of no greater than 20 microns.

15. A filter according to claim 11, wherein said epoxy resin material covers all of a top surface of the filter without extending beyond an outer periphery of the filter.

* * * * *